US007004349B2

(12) United States Patent
Heiberg et al.

(10) Patent No.: US 7,004,349 B2
(45) Date of Patent: Feb. 28, 2006

(54) CONTAINER WITH ELASTOMERIC LID SPRING

(75) Inventors: Jakob Heiberg, Charlottenlund (DK); Ian Tomas Benzon, Copenhagen (DK); Robert H. C. M. Daenen, Aalst (BE)

(73) Assignee: Dart Industries Inc., Orlando, FL (US)

( * ) Notice: Subject to any disclaimer, the term of this patent is extended or adjusted under 35 U.S.C. 154(b) by 235 days.

(21) Appl. No.: 10/633,422

(22) Filed: Aug. 1, 2003

(65) Prior Publication Data

US 2005/0023284 A1 Feb. 3, 2005

(51) Int. Cl.
*B65D 43/22* (2006.01)

(52) U.S. Cl. ..... 220/827; 220/324; 220/840; 220/833; 220/770; 220/264; 220/835

(58) Field of Classification Search ..... 220/827, 220/833, 835, 836, 840, 770, 772, 324, 263, 220/264; 16/35 D, 44, 286; 277/647; 267/141, 267/153, 158

See application file for complete search history.

(56) References Cited

U.S. PATENT DOCUMENTS 5,344,037 A 9/1994 Favre
5,494,185 A 2/1996 Dubach
5,501,348 A 3/1996 Takeuchi
5,620,107 A 4/1997 Takeuchi
5,669,522 A 9/1997 Million et al.
5,699,912 A * 12/1997 Ishikawa et al. ..... 206/494
5,762,216 A 6/1998 Takeuchi
5,788,064 A 8/1998 Sacherer et al.
6,206,221 B1 3/2001 Bando et al.
6,364,152 B1 4/2002 Poslinski et al.
6,857,639 B1 * 2/2005 Beeck et al. ..... 277/637
2004/0159661 A1 * 8/2004 Aochi ..... 220/264

FOREIGN PATENT DOCUMENTS

CH 686775 A5 * 6/1996
EP 1215130 A1 * 6/2002
JP 58074926 A * 5/1983

* cited by examiner

*Primary Examiner*—Robin A. Hylton

(57) ABSTRACT

A container body with a lid hingedly joined thereto for movement about a pivot axis utilizing an elastomeric spring of generally ellipsoidal configuration extending transversely across the pivot axis and having opposed ends seated within the container body and lid, the spring folding centrally at the area of maximum thickness with the elastic deformation biasing the lid to its open position upon release of the closing force on the lid. The pivotal hinge assembly is enclosed by an integral transversely extending handle panel outward of the hinge assembly.

15 Claims, 8 Drawing Sheets

CONTAINER WITH ELASTOMERIC LID SPRING

BACKGROUND OF THE INVENTION

The present invention relates to containers of the type including a container body with an open mouth selectively closed by a spring biased lid, and more particularly to such containers wherein the biasing action is provided by a rubber-like or elastomeric member mounted to and between the lid and the rim portion of the container body.

The prior art includes many examples of lidded containers wherein the closed lid, upon release of an appropriate latch, automatically moves to an open position impelled by a biasing spring. Such an opening force has, for the most part, normally heretofore been provided by metal springs of various types, including leaf or compression springs, torsion springs and the like.

As a variation and improvement on conventional metal springs, it has recently been proposed to use elastically deformable springs such as rubber. Two examples of such usage will be found in U.S. Pat. No. 5,501,348, to Takeuchi, and U.S. Pat. No. 6,206,221 D1 to Bando et al. Takeuchi utilizes a rather elaborately configured spring of L or channel configuration, relying in large part on the configuration for the spring action. Bando, to the contrary, utilizes what appears to be a rather simple flat elongate constant thickness strip which, upon compression, curls on itself and is received in an opening.

Another feature-known in the prior art which has a bearing on the present invention is the expedient of providing a handle assembly on a container body wherein the body includes a vertical recess in a portion of the body wall with the handle extending across the recess wherein the recess allows for engaging fingers inward of the handle for manipulation of the container. Note as an example U.S. Pat. No. Des.422,457 to Daenen et al and U.S. Pat. No. Des.423,294 to Klein. Also note U.S. Pat. No. 6,318,586 D1 to Frankenberg.

SUMMARY OF THE INVENTION

It is a primary intention of the present invention to advance the art as described above in a significant manner, particularly with regard to the use of rubber-like or elastomeric springs. In doing so, it is intended that springs in accord with the present invention provide, as compared with the known prior art, not only a highly efficient spring action, but also a spring which is both unique in structure and in the manner of use and operation thereof. In conjunction therewith, the present invention also proposes a handle assembly which provides a practical handle for the container body, particularly during the pouring of contents therefrom, and cooperatively relates to the lid hinge assembly so as to protectively and aesthetically enclose the hinge assembly and elastomeric spring.

Referring initially to the container and lid relationship, the lid, through a hinge assembly, is pivotally mounted to the container wall for free movement between a closed position overlying the container mouth and an open position upwardly swung from the container mouth to a substantially vertical position. The container body, vertically aligned with the hinge assembly and the open lid, includes a recess defined in the wall thereof. In the illustrated container embodiment, it will be noted that this wall recess in fact comprises substantially the entire rear wall of the container which, in conjunction with the narrow front wall of the container and the wide side walls thereof, present or form an oblong container, particularly desirable where shelf space might be limited. The hinge assembly includes a first component integral with the recessed wall or wall portion for a minor portion of the upper end thereof. This first hinge component is pivotally joined to a second hinge component affixed or integral with the under surface of the aligned portion of the lid. The container hinge component is enclosed by the handle which extends from the opposed side walls and transversely overlies the first hinge component in outwardly spaced relation thereto, thereby concealing the hinge component and defining a downwardly opening pocket or compartment to receive the fingers of a hand, allowing an upward lifting and manipulation of the container as desired.

The elastomeric spring, which comprises a particularly significant aspect of the invention, is distinct in its uniquely configured construction and in the particular advantages derived therefrom. More specifically, the spring, rather than being of a multi-angled configuration of webs, or a single flat constant thickness plate, is of what might be considered a generally ellipsoidal shape with opposed planar surfaces and both an elongate longitudinal cross-section which can be broadly referred to as oval or elliptical, and a transverse cross-section which is generally rectangular. More specifically, the spring of the invention is formed with a maximum thickness at the longitudinal central area thereof with the thickness of the spring tapering outwardly to the opposite sides of the central area to minimum thickness at the two opposed ends of the spring which in turn are arcuately formed. Thus, the thickness of the spring varies at a substantially constant rate from the center of the spring and transversely across the width thereof, in a direction longitudinally outward to the opposed ends, producing a spring with the area of maximum bending moment at the central area thereof which is also the area of maximum strength and, upon elastic deformation, the area of maximum developed memory induced force producing the desired lid opening action.

The formation of the spring in this manner provides significant advantages both with regard to the simplicity of the structural configuration and in the conservation of material and resultant economies. The variable thickness of the spring provides for a concentration of the bulk of material in the area of greatest value with only minimum material being required and utilized toward the opposed positioning and/or anchoring ends of the spring. The formation of such springs with different force components allows for a concentration of the bulk of material within the central area of maximum stress, as opposed to any teachings in the constant thickness elastomeric springs heretofore proposed.

In mounting the spring, the spring extends across the pivot axis of the hinge assembly with the opposed ends of the spring retained against opposed abutments on the container and lid with the orientation of the spring causing, upon a manual closing of the lid to its latch position, a single folding of the spring at the central area thereof, the area of maximum strength and elastic memory, to achieve the desired increase of biasing force required to open the lid upon release thereof. This simple single folding action is all that is required, in conjunction with the unique configuration of the spring, to provide a highly effective and efficient operation.

Other features, objects and advantages of the invention will become apparent to those skilled in the art from the following more detailed description of the invention.

DESCRIPTION OF PREFERRED EMBODIMENT

Figure 1:
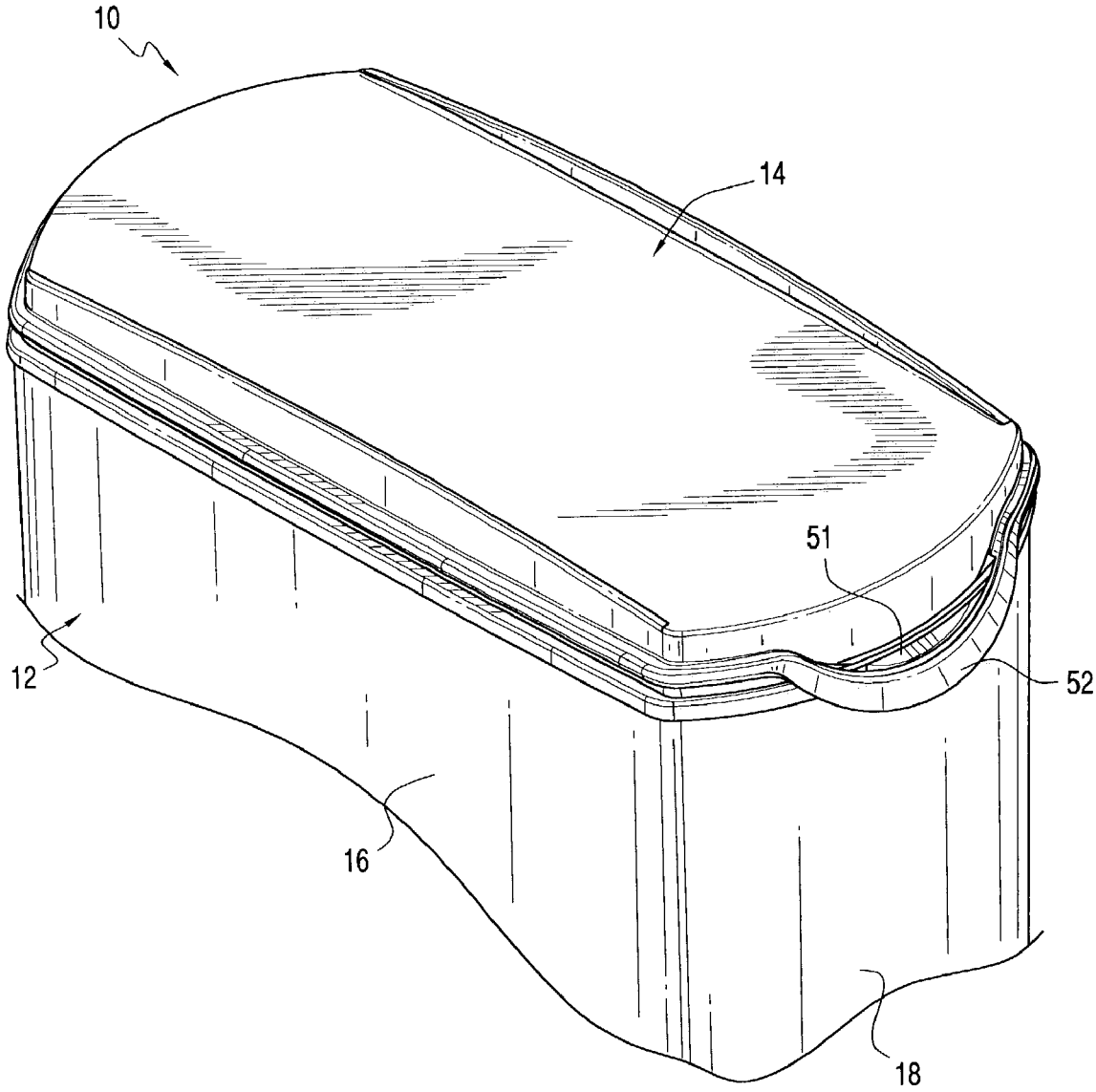
FIG. 1 is a front and side perspective view of the upper portion of the container of the invention with the lid closed.

Referring now more specifically to the drawings, the container 10, which for purposes of illustration has been presented as an elongate rectangular canister, includes a container body 12 and a container lid 14 pivotally mounted to the body for selectively closing the container mouth. In the illustrated embodiment, the container body 12 includes wide side walls 16 and relatively narrower front and rear walls 18 and 20.

Figure 2:
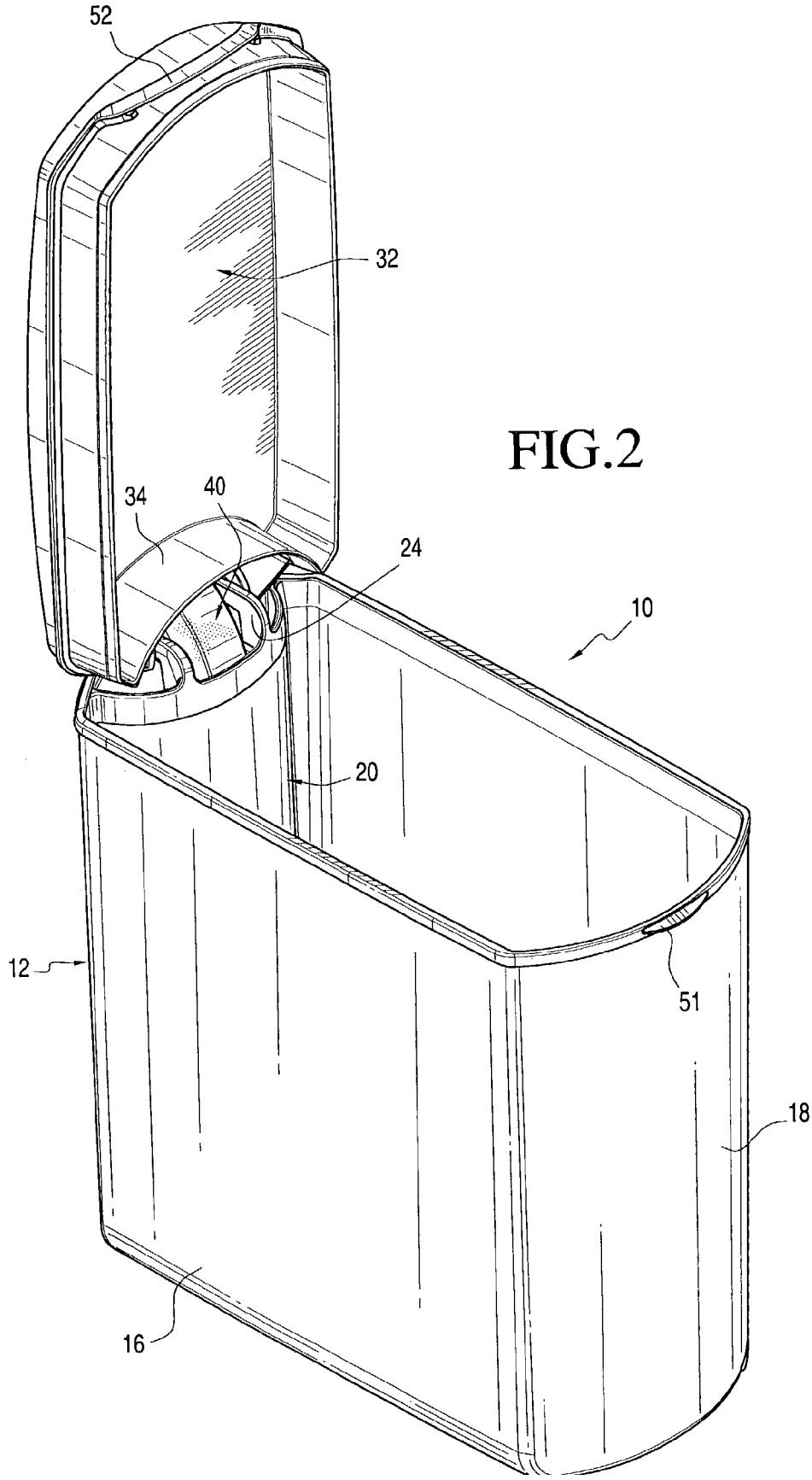
FIG. 2 is a view illustrating the container with the lid fully open.
Figure 4:
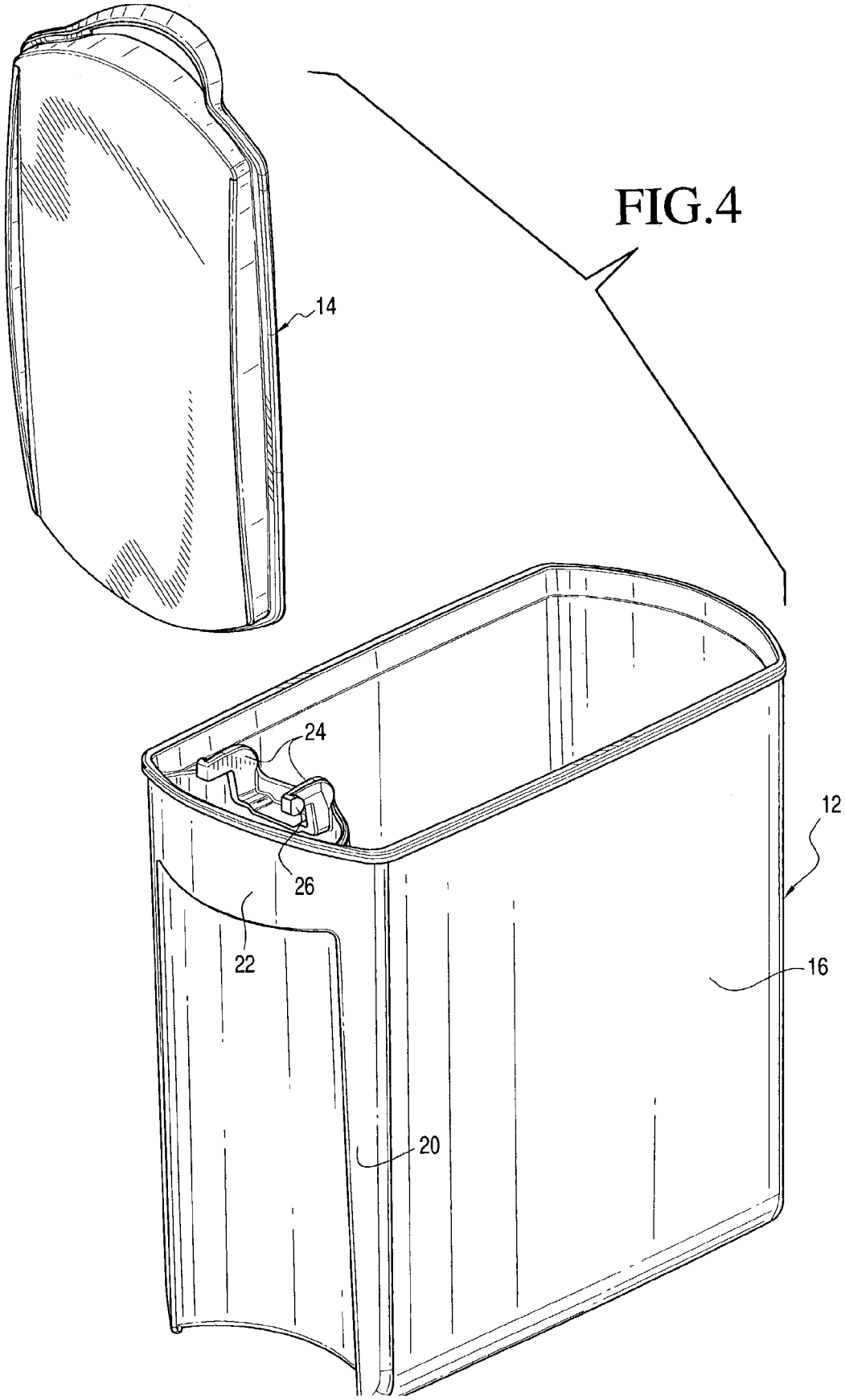
FIG. 4 is a rear perspective view of the container with the lid exploded and without the elastomeric spring.

The rear wall 20, note FIGS. 2 and 4, is inwardly arcuately recessed for at least a major portion of the height and width thereof. An arcuate handle 22, integral with the opposed side walls 16, arcs transversely across the rear wall recess for a minor portion of the height of the recess at the upper end thereof. Thus formed and positioned, the container can be easily lifted by the handle by engaging one's fingers about the handle and upwardly into the compartment or pocket formed between the handle and recess.

Figure 3:
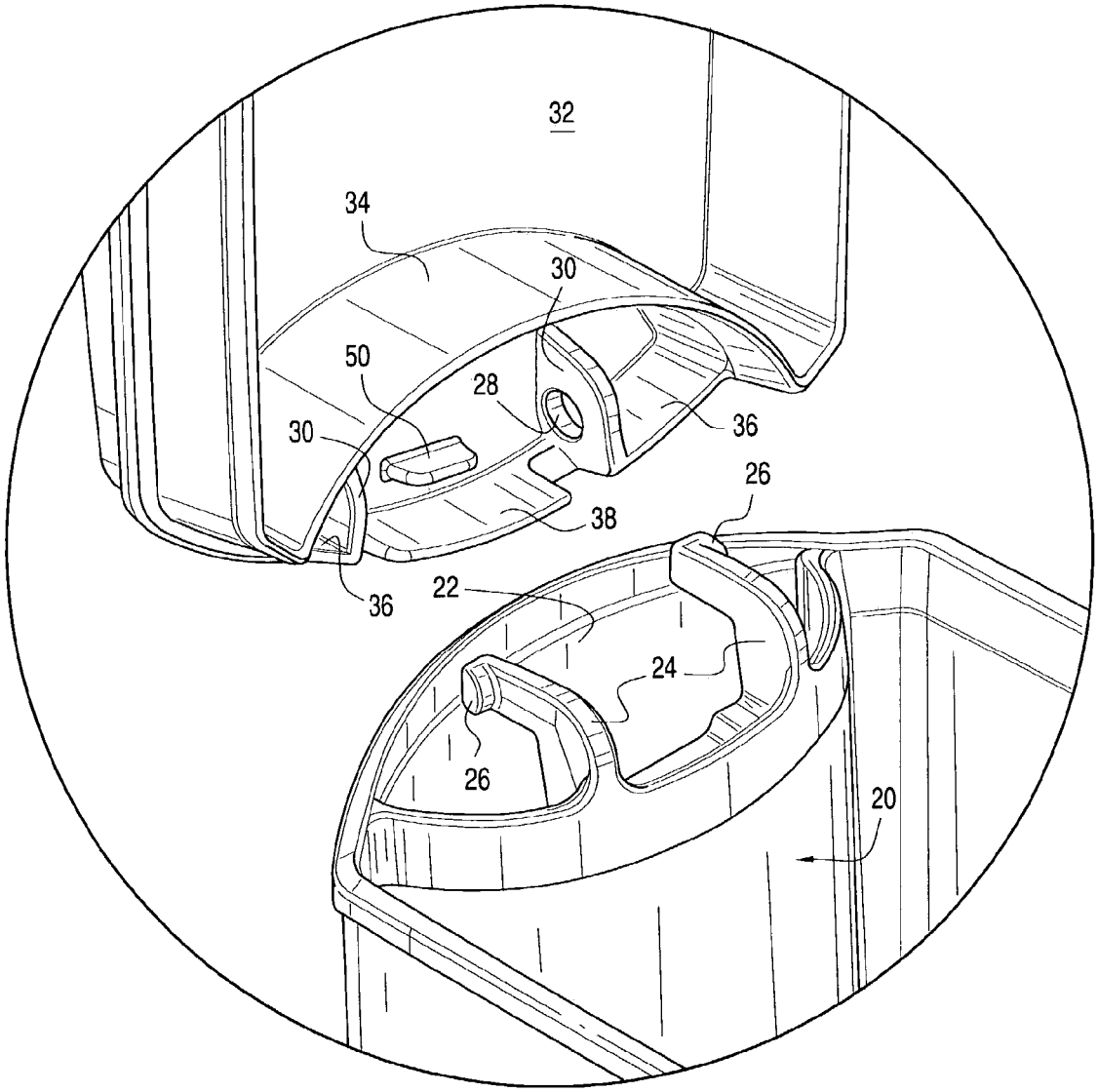
FIG. 3 is an exploded perspective view of the hinge assembly with the spring removed.

The hinge assembly, that is the means by which the lid is pivotally mounted to the container body, is protectively enclosed and concealed within the formed handle pocket upwardly spaced from the lower edge of the handle. Noting FIGS. 3 and 4 in particular, a pair of laterally spaced rearwardly directed support arms 24 are integrally formed with the recessed rear wall portion and extend rearwardly therefrom, each terminating in a laterally outwardly directed short pivot pin 26 which combine to define the pivot axis for the lid.

Figure 5:
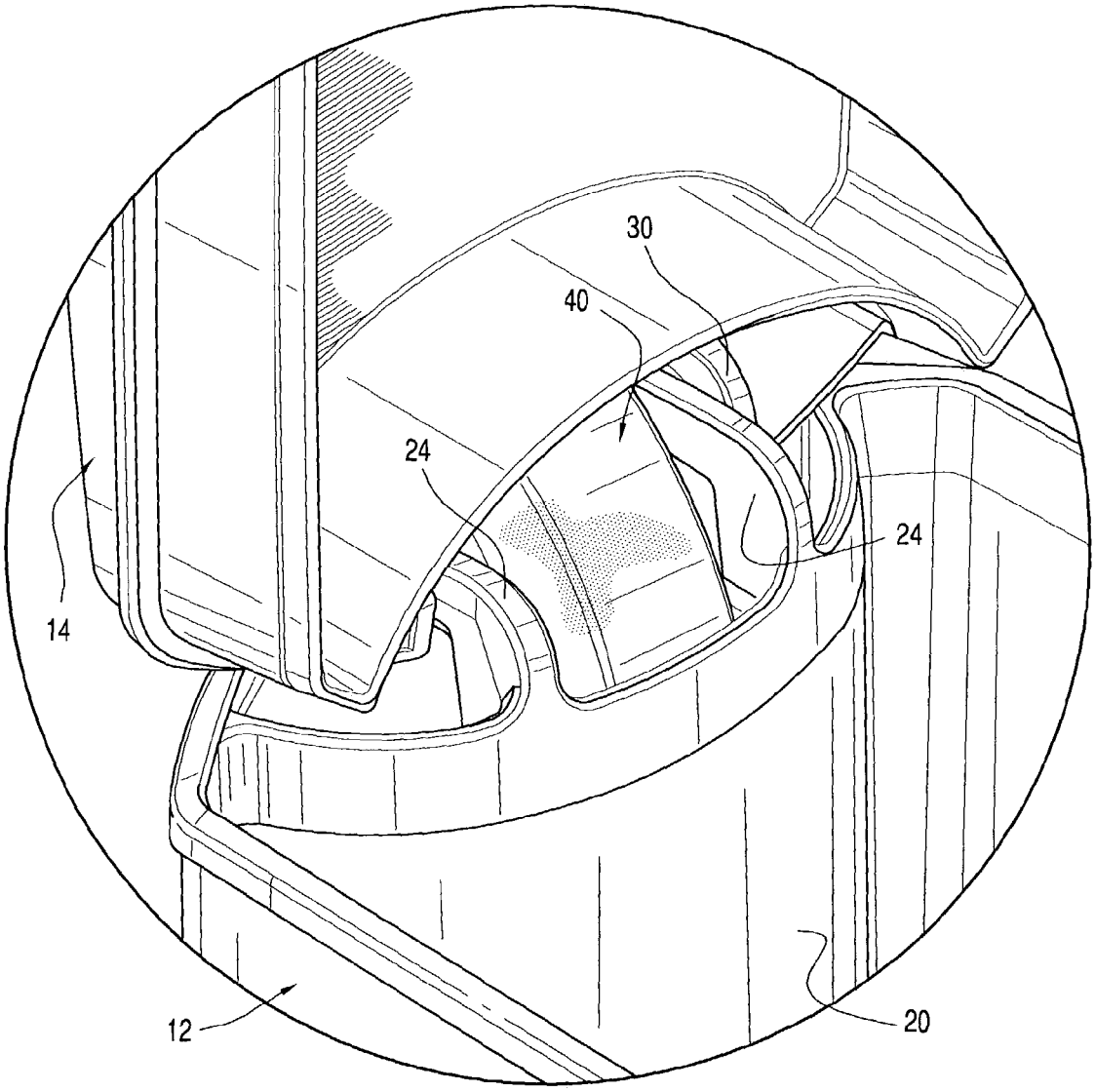
FIG. 5 is a detail similar to FIG. 3 with the hinge components engaged and with the spring mounted.

Each pivot pin 26 is rotatably received within a socket or bearing aperture 28, only one of which is shown, defined in a pair of laterally spaced partitions or mounting blocks 30 integral with and depending from the top panel 32 of the lid. As desired, the pin support arms 24 can include a small degree of flexibility to allow for a snap mounting of the lid to the container body. Noting FIGS. 3 and 5, the lid 14, at the hinge assembly, will also include an integral arcuate depending wall 34 which, upon a closing of the lid, seats just inwardly of the arcuate or recessed rear wall 20 of the container body for preventing any accidental discharge of contents from the container body with the lid fully closed. A similar shorter lid rear wall 36,-which will tend to stabilize the partitions or mounting blocks 30 which receive the pivot pins 26, also depends from the lid top panel 32 along an arcuate curvature corresponding to that of the handle 22 and lays immediately inward thereof in the closed position of the lid as noted in FIGS. 6 and 7. This rear wall, noting FIG. 6 in order to allow for free movement of the lid 14 without interference with the pivot pin support arms 24, can, if necessary, have a pair of recesses 38 therein aligned with the arms 24.

Of particular significance with regard to the present invention is the manner in which provision is made for the spring biased opening of the lid away from the container rim which defines the mouth of the container. This is achieved utilizing a highly unique although structurally simple spring or spring unit 40 detailed in FIGS. 10–13. The spring 40 is formed of an appropriate elastomer or rubber-like material, preferably silicone and, while the size can vary, may as an example be 30 mm long and 10 mm thick at its widest position for use with a container of the type illustrated herein with a general capacity of approximately 1.7 liters. The configuration of the spring 40 is what might be considered elliptical or oval in longitudinal cross section with a central area of maximum thickness. The spring arcuately tapers to opposed ends of minimum thickness, preferably at a constant and equal rate toward the opposite ends along opposed or upper and lower arcing surfaces. The opposed ends 42 of the spring are rounded and the opposed sides or side faces 44 are flat. The spring, so formed and with the ends retained as illustrated, is intended to fold in half with the bend at the maximum thickness central area wherein the greatest strength and bending moment occurs for maximum simplicity and efficiency.

Figure 9:
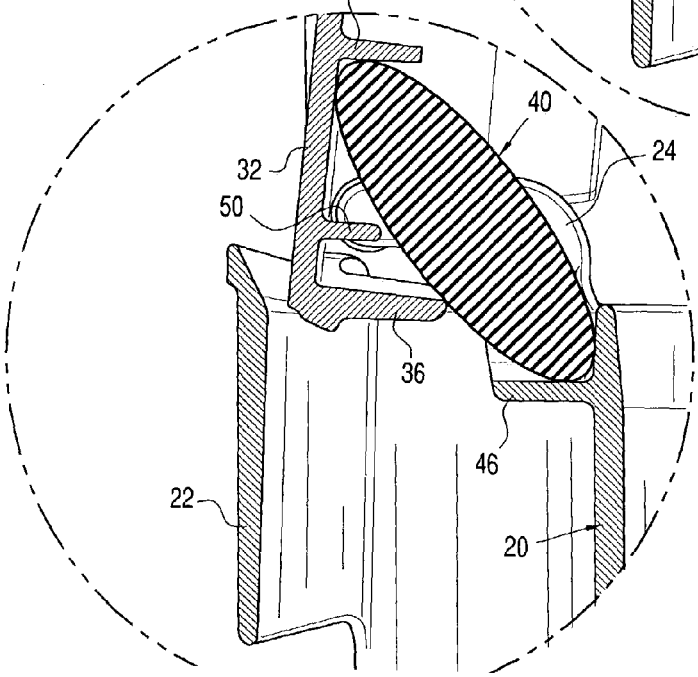
FIG. 9 is a similar detail view with the spring fully extended and the lid retained at its open position.
Figure 10:
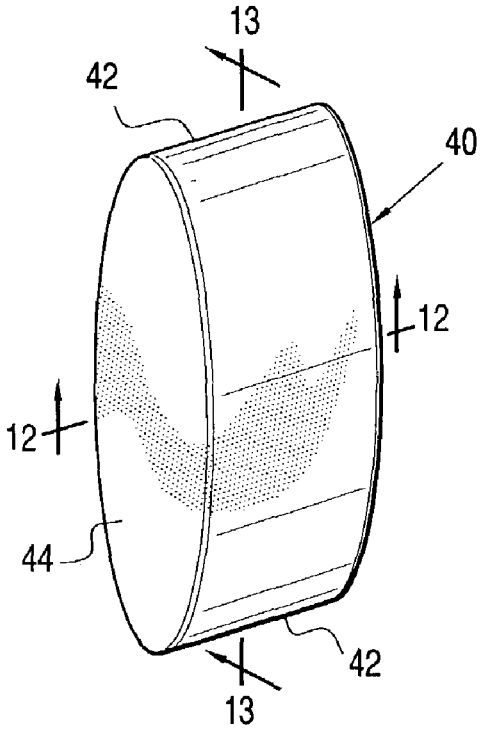
FIG. 10 is a perspective view of the elastomeric spring of the invention illustrating the tapering configuration thereof.
Figure 12:
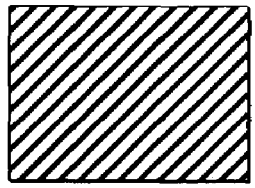
FIG. 12 is a transverse cross-sectional view taken substantially on a plane passing along line 12—12 in FIG. 10.
Figure 11:
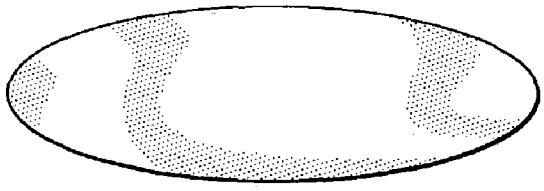
FIG. 11 is a side elevation view of the spring illustrating both the taper and the preferred symmetry thereof.
Figure 13:
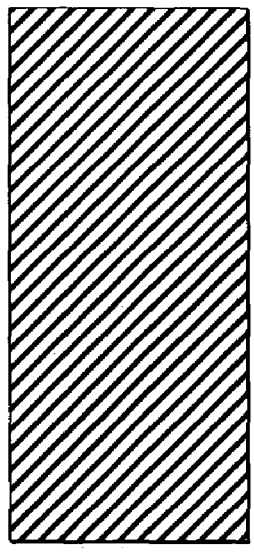
FIG. 13 is a longitudinal cross-sectional view taken substantially on a plane passing along line 13—13 in FIG. 10.

Noting FIG. 9 in particular, the spring 40 can easily snap into position within the hinge area extending across the pivot axis between the support arms 24 with a first or container end of the spring seated on a ledge 46 integral with and extending rearward from the rear wall 20 and both abutted against the rear wall 20 and nested within a corner defined between the rear wall 20 and the inner end of the ledge 46. The second or lid end of the spring 40 similarly engages against an inwardly extending shoulder or abutment 48 integral with and extending from the lid top panel 32 with the corresponding end of the spring 40 nested within the corner defined between the top panel 32 and shoulder 48. The spring is stable in this substantially unstressed position and is retained, generally without elastic deformation, nested at the opposed ends thereof. The stabilization of the spring 40 in this position may be enhanced by a positioning abutment or wall 50 which projects from the undersurface of the lid panel 32 and engages the spring generally at the widest central area thereof. In this fully open position of the lid, it will be noted that the rear depending wall 36 of the lid can also engage and encourage both a retention of the spring 40 and a complementary retention of the lid in an upright fully open position. Any tendency of the lid to freely move from the open position in either direction will be effectively resisted by the inherent strength of the spring itself which requires a positive manual force to compress from its at rest position.

Figure 7:
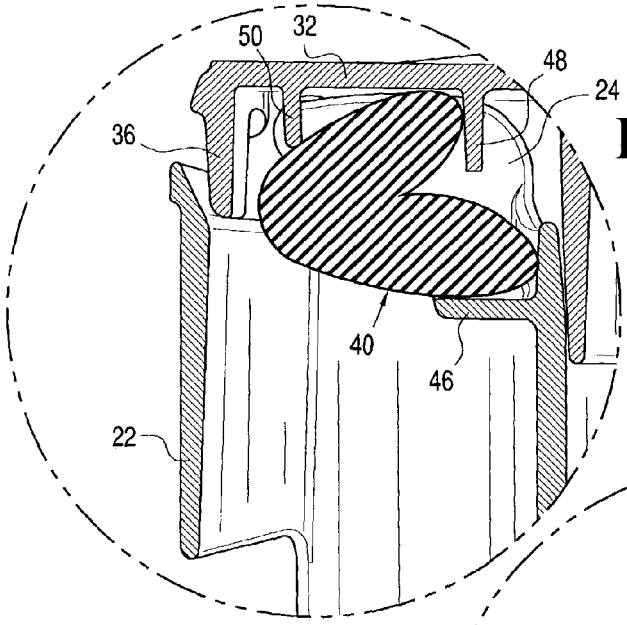
FIG. 7 is an enlarged detail view of the area designated in FIG. 6 with the spring fully compressed.
Figure 8:
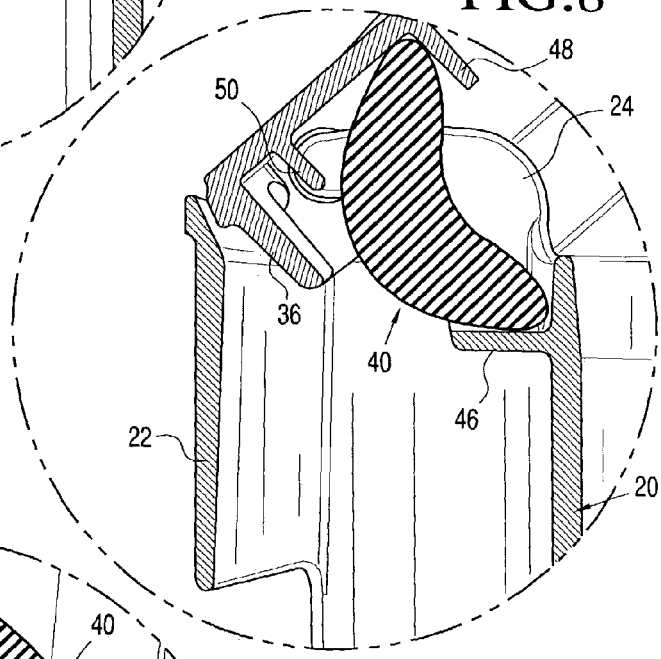
FIG. 8 is a similar view with the lid partially biased open by the unfolding spring.

Noting the sequential steps of FIGS. 8 and 7, as the lid is moved to its closed position, a manual downward pivoting of the lid, against the biasing force of the spring 40, will move the abutment wall 50 of the lid relatively rearward and allow for a central folding of the spring 40 rearward as the upper portion of the spring folds downward with the actual bending occurring at the wide central area of the spring. This folding action is encouraged by the shoulder 48 and by the upper rim area of the rear wall 20 above ledge 46 both of which generally engage the forward face of spring 40 and prevent any tendency for the spring to fold forwardly. A simple single fold action results and a maximum biasing or elastic memory force is developed which, upon release of the lid, causes the lid to spring upwardly and rearwardly to its open position, at which point the lid is stabilized by the inherent strength of the spring in its unbiased condition, or possibly by a slight compressive force retained within the spring. It is also to be appreciated that the forming of the pivot axis by two spaced pivot pins allows for the positioning and folding of the spring directly at the pivot axis in a compact manner and in a manner which achieved maximum efficiency.

Figure 6:
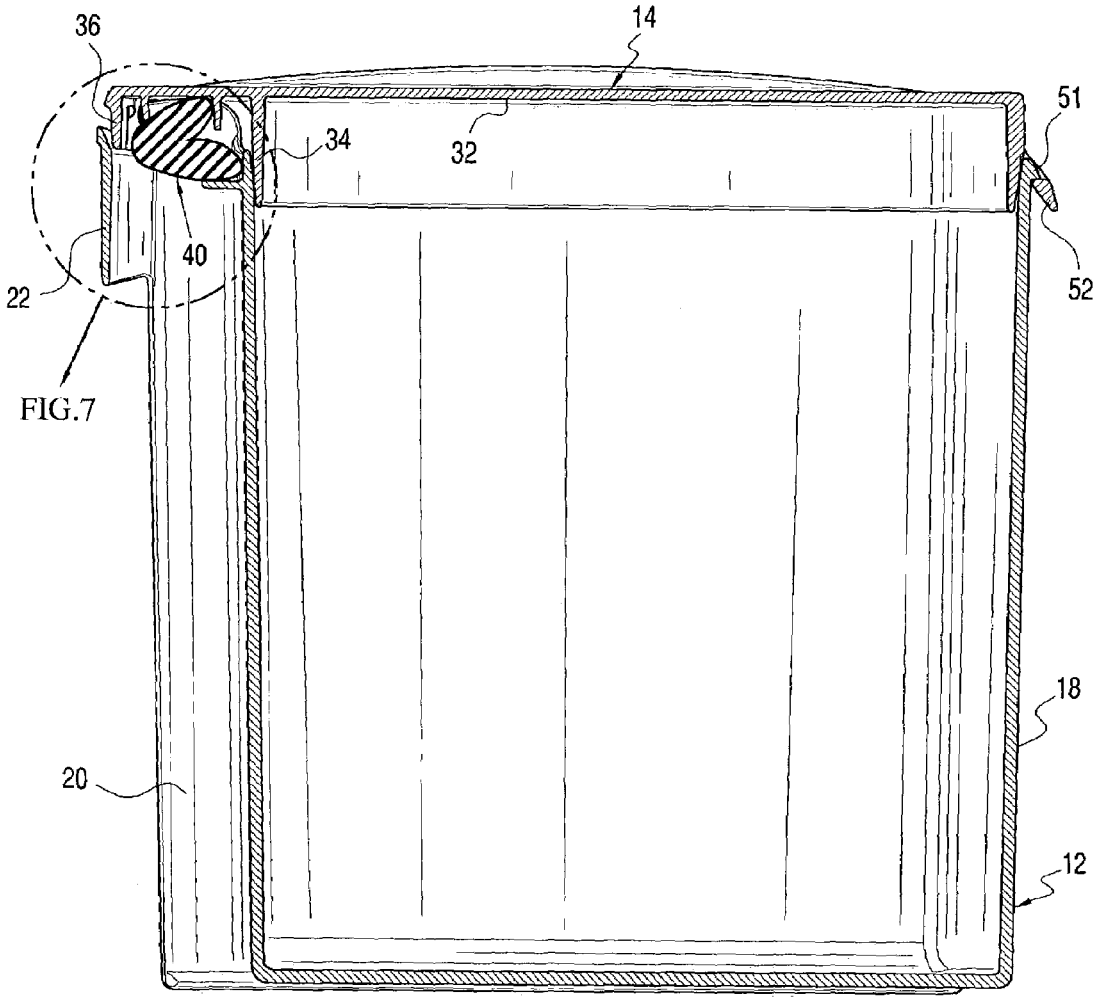
FIG. 6 is a longitudinal cross-section view through the closed container with the lid-opening spring in its fully compressed position.

As will be recognized, any appropriate latch mechanism can be used to retain the lid closed against the biasing force of the spring. For example, as illustrated in FIGS. 1 and 6, the front wall 18 of the container body can be provided, at the rim of the container with a locking projection or abutment 51 which snap locks within the aperture of a depending latch 52 extending from the forward end of the lid 14. Release of the latch will require only a slight forward and upward flexing thereof so as to free the abutment, at which point the lid will move smoothly to its fully open position.

The foregoing is illustrative of the principles of the invention, and while a specific embodiment of the invention has been set forth in detail, it is to be appreciated that variations may occur to those skilled in the art, such as dimensional changes resulting in both larger and smaller containers, and containers of shapes other than the basic oval shape illustrated, all without departing from the spirit and scope of the invention as set forth in the following claims.

What is claimed is:

1. A container comprising a container body with an upwardly opening mouth defined by a peripheral rim, a lid for said body, a hinge assembly mounting said lid on said body for pivotal movement of the lid relative to the body about a pivot axis between a first closed position overlying and enclosing said container mouth and a second open position upwardly pivoted away from said mouth, and a spring of an elastomeric material extending transverse across said pivot axis, first retaining means on said body retaining a first end of said spring, second retaining means on said lid retaining a second opposed end of said spring, said spring having an area of maximum thickness centrally between said first and second ends, said spring tapering in opposite directions from said central area of maximum thickness to a minimum thickness at each said first and second end, said spring in said open position of said lid extending in a substantially linear position and elastically resisting pivotal movement of said lid to said closed position, said spring, upon manual movement of said lid to said closed position, folding centrally at said area of maximum thickness against an inherent elastic memory in said spring biasing said spring to said linear position, and latch means for releasably retaining said lid in said closed position, said spring upon release of said latch means forcibly moving said lid to and retaining said lid in said open position.

2. The container of claim 1 wherein said spring, in longitudinal cross-section is of a substantially elliptical configuration.

3. The container of claim 2 wherein said spring has opposed planar longitudinal sides.

4. The container of claim 3 wherein each of said first and second retaining means comprises an abutment against which the corresponding end of said spring nests.

5. The container of claim 4 wherein said pivot axis is defined by a pair of longitudinally spaced pivot pins, said spring mounting and folding substantially transversely between said spaced pivot pins.

6. The container of claim 5 wherein said container body has peripheral walls, said hinge assembly including a pair of laterally spaced support arms fixed to one of said container body walls and extending outwardly relative thereto, said pins being mounted on said arms, said hinge assembly further including a pair of laterally spaced pin receiving bearing means on said lid and rotatably receiving said pins.

7. The container of claim 6 including a handle mounted to said container body walls and extending transversely across said laterally spaced support arms in outwardly spaced relation thereof.

8. The container of claim 1 wherein each of said first and second retaining means comprises an angular seat receiving, retaining and stabilizing the corresponding ends of said spring.

9. The container of claim 8 including a stabilizing projection on said lid extending therefrom and selectively engaging said spring adjacent the central area thereof in said open position of said lid.

10. The container of claim 1 wherein said pivot axis is defined by a pair of longitudinally spaced pivot pins, said spring mounting and folding substantially transversely between said spaced pivot pins.

11. The container of claim 10 wherein said container body has peripheral walls, said hinge assembly including a pair of laterally spaced support arms fixed to one of said container body walls and extending outwardly relative thereto, said pins being mounted on said arms, said hinge assembly further including a pair of laterally spaced pin receiving bearing means on said lid and rotatably receiving said pins.

12. In a container including a container body and lid, pivot means mounting said lid to said body for pivotal movement of the lid relative to said body between an open position and a closed position, an elastomeric spring positioned between said container body and said lid, said spring being of a generally elliptical configuration with a central area of maximum thickness and longitudinally opposed ends of minimum thickness, retaining means on said container body and said lid for respectively receiving and retaining the opposed ends of said spring, said spring, in said open position of said lid, extending linearly with minimal elastic deformation, said spring, in said closed position of said lid, being folded at the area of maximum thickness centrally on itself and in maximum elastic deformation.

13. The container of claim 12 wherein longitudinal upper and lower surfaces on said spring are equally and oppositely arced.

14. The container of claim 13 wherein opposed longitudinal faces on said spring are planar and parallel to each other.

15. The container of claim 14 wherein the retaining means on said container and lid freely receive the opposed ends of said spring with the elasticity of said spring retaining said spring ends in engagement with said retaining means.

* * * * *